US007422206B2

(12) United States Patent
Okuda et al.

(10) Patent No.: US 7,422,206 B2
(45) Date of Patent: Sep. 9, 2008

(54) RETURNER INCORPORATED IN AUTOMATIC FEEDER, AND RECORDING APPARATUS OR LIQUID OR LIQUID EJECTING APPARATUS PROVIDED WITH THE SAME

(75) Inventors: Yasumichi Okuda, Nagano (JP); Yoshihiro Kobayashi, Nagano (JP); Kazuhito Hori, Nagano (JP); Naohiro Ueyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 318 days.

(21) Appl. No.: 11/236,945

(22) Filed: Sep. 27, 2005

(65) Prior Publication Data

US 2006/0072000 A1 Apr. 6, 2006

(30) Foreign Application Priority Data

Sep. 27, 2004 (JP) ..... P2004-280718

(51) Int. Cl.
*B65H 3/52* (2006.01)

(52) U.S. Cl. ..... 271/121; 271/122; 271/124

(58) Field of Classification Search ..... 271/121, 271/122, 124
See application file for complete search history.

(56) References Cited

U.S. PATENT DOCUMENTS 5,655,762 A 8/1997 Yergenson
5,863,038 A * 1/1999 Zoltner ..... 271/127

(Continued)

FOREIGN PATENT DOCUMENTS

EP 1 256 534 A2 11/2002

(Continued)

OTHER PUBLICATIONS

Extended European Search Report dated Dec. 4, 2006.

*Primary Examiner*—Patrick Mackey
*Assistant Examiner*—Luis A Gonzalez
(74) *Attorney, Agent, or Firm*—John J. Penny, Jr.; Edwards Angell Palmer & Dodge LLP

(57) ABSTRACT

A feeding tray supports a plurality of media the media thereon. A hopper is provided on the feeding tray so as to be movable in a first direction for pushing the media toward a feeding roller so that a top one of the media comes in contact with the feeding roller, and in a second direction opposite to the first direction. A separator separates a first group including at least one of the media which is situated under the top one of the media from the top one, so that only the top one is fed to the downstream section by rotation of the feeding roller. A returning lever is pivotable interlockingly with the feeding roller and adapted to return a second group including at least one of the media in the first group, which has been proceeded from a prescribed position to the downstream section together with the top one of the media, to the feeding tray. A holder supports a third group including at least one of the media in the first group which is situated under the second group. The holder is slidable in the second direction interlockingly with the movement of the hopper in the second direction to move the third group toward the feeding tray to secure a space to which the second group is returned by the returning lever.

7 Claims, 10 Drawing Sheets

U.S. PATENT DOCUMENTS

| | | | | |
|---|---|---|---|---|
| 6,331,002 | B1 * | 12/2001 | Yoshino et al. | 271/117 |
| 7,029,004 | B2 * | 4/2006 | Asada et al. | 271/121 |
| 7,210,677 | B2 * | 5/2007 | Fukumura et al. | 271/10.01 |

FOREIGN PATENT DOCUMENTS

| | | |
|---|---|---|
| EP | 1 500 618 A1 | 1/2005 |
| JP | 9-118447 | 5/1997 |
| JP | 11-71036 | 3/1999 |
| JP | 2001-72271 | 3/2001 |
| JP | 2003-276861 | 10/2003 |

* cited by examiner

RETURNER INCORPORATED IN AUTOMATIC FEEDER, AND RECORDING APPARATUS OR LIQUID OR LIQUID EJECTING APPARATUS PROVIDED WITH THE SAME

BACKGROUND OF THE INVENTION

In a recording apparatus (liquid ejecting apparatus) provided with an automatic feeder, a plurality of recording media (target media) are stacked on a media feeding tray and a top one of the recording media is picked up by a hopper and a separator and fed to the inside of the recording apparatus. The present invention relates to a returner for returning at least one recording medium accompanied with the top one to the medium feeding tray.

The term "liquid ejecting apparatus" as used herein includes not only recording apparatus such as a printer, a copier, and a facsimile machine that use an ink jet recording head and perform recording on a recording material by ejecting ink from the recording head but also an apparatus that ejects liquid suitable for a purpose instead of ink from a liquid ejecting head toward a target material and thereby cause the liquid to land on the target material.

Examples of the liquid ejecting head other than the recording head are a colorant ejecting head used for manufacture of color filters of a liquid crystal display or the like, an electrode material (conductive paste) ejecting head used for formation of electrodes of an organic EL display, a field emission display (FED), or the like, a bioorganic material ejecting head used for manufacture of a biochip, and a sample ejecting head as precision pipettes.

An ink jet printer as an example of the ink jet recording apparatus or the liquid ejecting apparatus will be hereinafter described.

In the ink jet printer, in the event of what is called a multiple feed in which plural sheets are picked up in such a manner as to lie one on another, the single top sheet is separated from the lower sheets by a separating action of a separator such as a separation pad, a retarding roller, or the like. The ends of separated lower sheets are hooked on a hook member of a returning lever and the lower sheets are thereby returned to a feeding tray.

Japanese Patent Publication No. 11-71036A discloses a structure that two separation pads. A main separation pad first acts on sheets to perform a first separating operation and then an auxiliary separation pad acts on the sheets to perform a second separating operation, thereby separating the sheets reliably. Capable of rotating in both of the normal and reverse directions, the auxiliary separation pad disclosed in this publication also has a function of returning lower sheets to the feeding tray by rotating in the reverse direction when a hopper separates the sheets from a feeding roller. As such, it can be said that the auxiliary separation pad has also the sheet returning function.

However, in a case where many stacked sheets having a large size such as A3 sheets are subjected to the returning operation, the returning lever or the auxiliary separation pad cannot return those sheets by itself to the prescribed positions on the feeding tray because the returning force is not strong enough to sustain the weight of those sheets. More specifically, as shown in FIG. 8, among sheets P that are pressed against the feeding roller 102 as the hopper 101 is elevated, the single top sheet P0 is fed into a transporting path while several top sheets P1 are remained in such a condition as to be somewhat pulled from sheets P2 located under themselves toward the transporting path.

Because of the frictional force caused by their own weight, the lower sheets P2 also remain in close contact with the sheets P1 without sliding down on a support frame 103 below. Even if the returning lever 104 or the auxiliary pad disclosed in this publication is caused to operate in this state, only the upper sheets P1 are subjected to the sheet returning action. Since the lower sheets P2 stand by behind in such a manner as to be in close contact with the upper sheets P1 and hence there is no return space, the attempt of returning the sheets P1 is not completed.

One conventional measure against the above problem is to decrease the attachment angle of a paper support attached to the feeding tray so that not all of the weight of sheets P is exerted on the support frame 103 and the returning lever 104 or the like. However, decreasing the attachment angle of the paper support leads to size increase of the ink jet printer and is a factor of disordering the arrangement of the sheets P. Further, it is not certain whether sheets P can be returned onto the feeding tray reliably even by decreasing the attachment angle of the paper support.

SUMMARY OF THE INVENTION

It is therefore an object of the invention to provide a returner which can always return remaining recording media (target media) to the prescribed positions on a medium feeding tray reliably, even in the case where heavy, large-size recording media or a large number of recording media are stacked on the medium feeding tray, and can thereby contribute to size reduction of an apparatus.

It is also an object of the invention to provide an automatic feeder incorporating such a returner, and a recording apparatus or a liquid ejecting apparatus provided with such an automatic feeder.

In order to achieve the object, according to the invention, there is provided an automatic feeder, adapted to feed a plurality of media one by one to a downstream section, comprising:

a feeding tray, adapted to support the media thereon;

a feeding roller;

a hopper, provided on the feeding tray so as to be movable in a first direction for pushing the media toward the feeding roller so that a top one of the media comes in contact with the feeding roller, and in a second direction opposite to the first direction;

a separator, adapted to separate a first group including at least one of the media which is situated under the top one of the media from the top one, so that only the top one is fed to the downstream section by rotation of the feeding roller;

a returning lever, pivotable about a pivot shaft interlockingly with the feeding roller and adapted to return a second group including at least one of the media in the first group, which has been proceeded from a prescribed position to the downstream section together with the top one of the media, to the feeding tray; and a holder, having a supporting face on which a third group including at least one of the media in the first group which is situated under the second group is placed, the holder being slidable in the second direction interlockingly with the movement of the hopper in the second direction to move the third group toward the feeding tray to secure a space to which the second group is returned by the returning lever.

With this configuration, it is possible to reliably return heavy, large-size media or a large number of stacked media that would not be returned to the prescribed positions on the feeding tray by the returning lever alone. This in turn makes it possible to smoothly perform the media feeding operations that are performed successively. Further, this aspect of the invention contributes to downsizing of an apparatus because it is not necessary to change the attachment angles of the feeding tray and a paper support or the like that is attached to the feeding tray.

A high-friction member may be provided on the supporting face of the holder. In this case, the friction acting on the lower media, among the remaining media, whose ends are in contact with the supporting face of the holder, whereby the lower media can reliably be supported by the holder and be returned to the prescribed positions on the feeding tray.

The automatic feeder may further comprise a frame member having a supporting face on which the first group is placed, the frame member formed with a groove extending in the second direction. The holder may comprises a projection slidably fitted with the groove. In this case, the holder is allowed to slide smoothly in the second direction by virtue of the guide action of the projection and the groove.

The automatic feeder may further comprise an elastic member urging the holder in the first direction. The holder may comprise a projection adapted to engage with the hopper when the hopper is moved in the second direction. In this case, the holder is moved in the second direction because of its engagement with the hopper and is moved in the first direction by the urging action of the elastic member. Therefore, the hopper is used as a member for sliding the holder, which means efficient use of the components.

The automatic feeder may further comprise a rotation cam provided on the pivot shaft of the returning lever. The holder may be formed with a cam follower so that the holder is pivotable in accordance with rotation of the rotation cam, thereby varying an inclination angle of the supporting face.

In this case, the holder lifts up the media on the supporting face while sliding in the second direction, thereby helping the operation of returning the media onto the feeding tray.

According to the invention, there is also provided a recording apparatus incorporating the above automatic feeder and comprising a recording head, disposed in the downstream section and operable to record information on the top one of the media fed by the feeding roller.

In this case, since the transporting accuracy of recording media is increased, high-quality recording is enabled.

According to the invention, there is also provided a liquid ejecting apparatus incorporating the above automatic feeder and comprising a liquid ejecting head, disposed in the downstream section and operable to eject liquid toward the top one of the media fed by the feeding roller.

In this case, since the transporting accuracy of target media is increased, high-quality landing of the liquid on the target medium is enabled.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
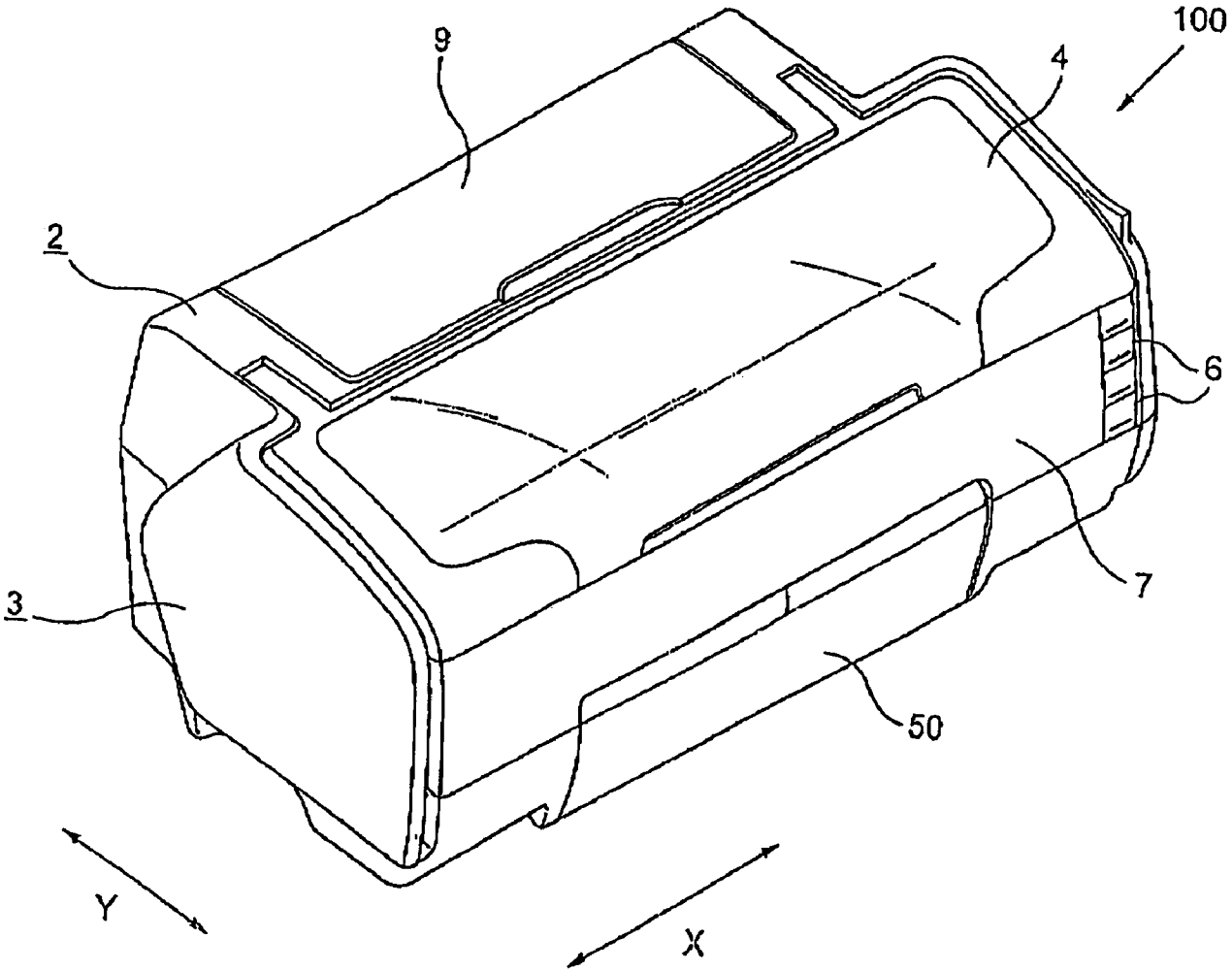
FIG. 1 is a perspective view of an ink jet printer according to one embodiment of the invention.
Figure 2:
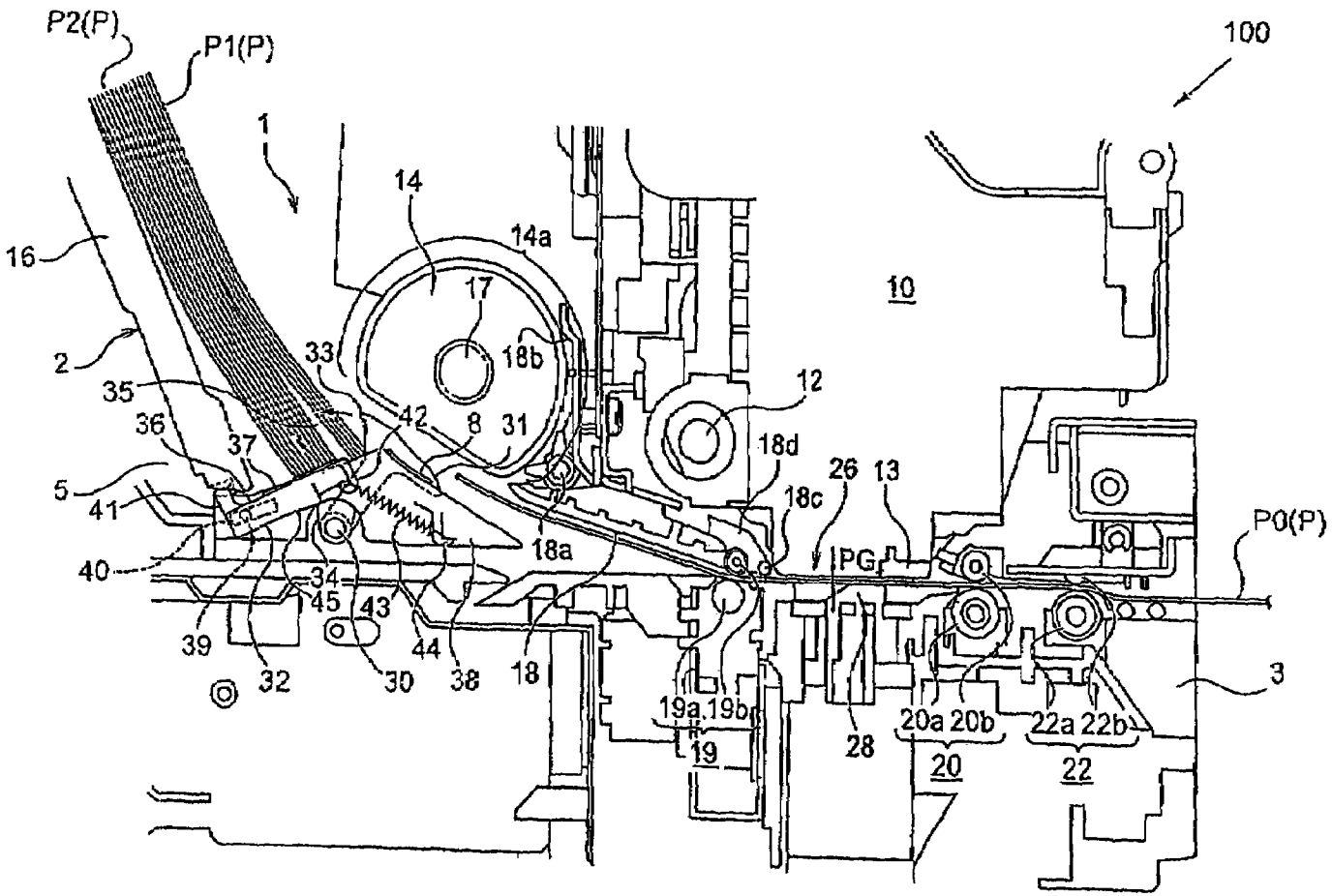
FIG. 2 is a side section view of an internal structure of the ink jet printer.
Figure 3:
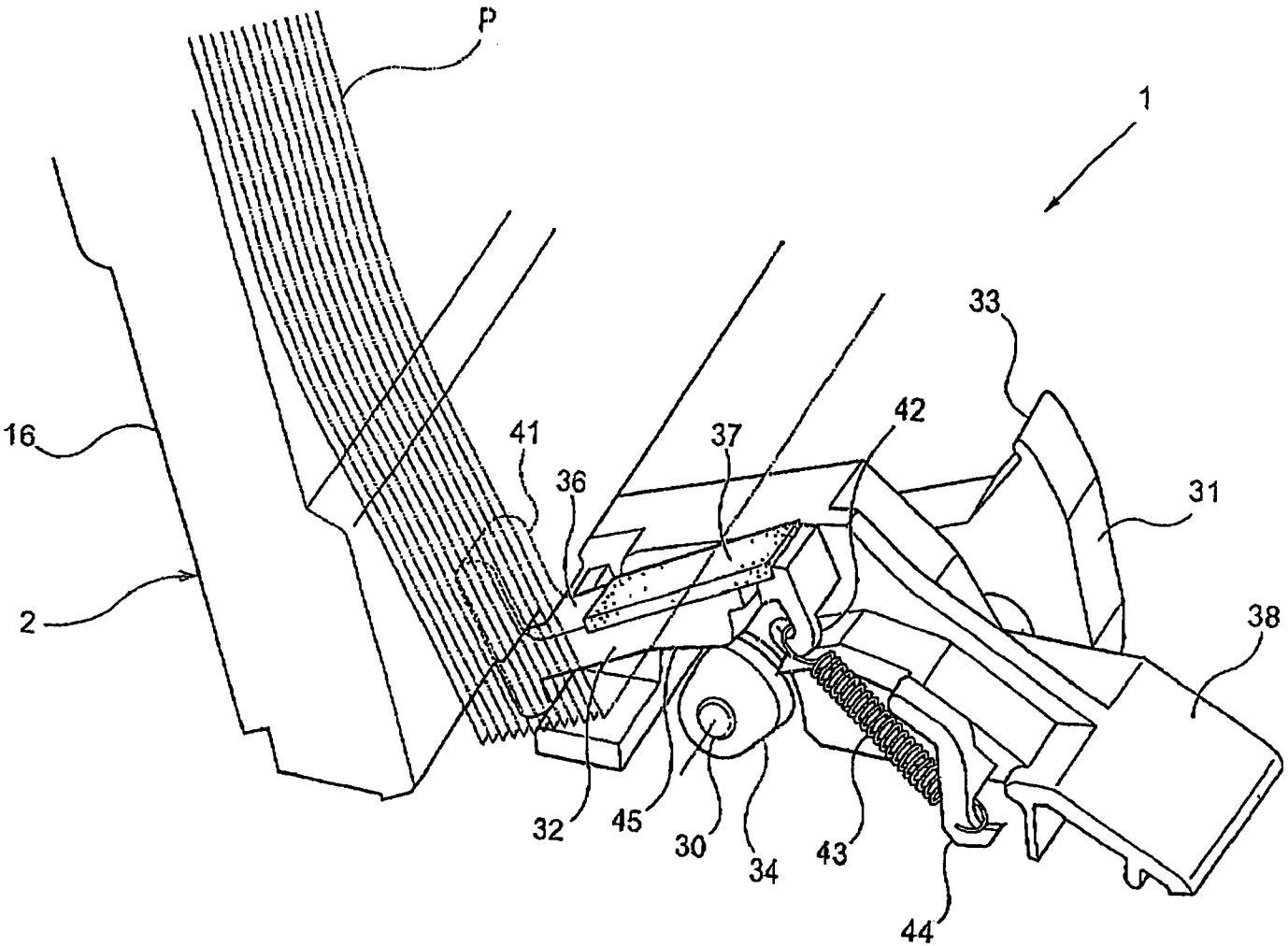
FIG. 3 is an enlarged perspective view of a returner and its peripheries in the ink jet printer.

Embodiments of the invention will be described below in detail with reference to the accompanying drawings. An ink jet printer 100 shown in FIG. 1 is exemplified as the recording apparatus or the liquid ejecting apparatus of the invention.

The ink jet printer 100 comprises: a top cover 4 which occupies a front portion of the top face of a printer main body 3; manipulation buttons 6 located at the top-right corner of the front face of the printer main body 3; a disc tray cover 7 which occupies a top portion of the front face of the printer main body 3; an ejection stacker 50 which occupies a bottom-front portion of the printer main body 3; and an automatic feeder 2 which occupies a top-rear portion of the printer main body 3. As such, the ink jet printer 100 is an ink jet printer capable of dealing with a recording medium P (hereinafter referred simply as "sheet P") as an example of a large-size (e.g., A3) target medium.

The top cover 4 is a door cover in which the front side can be opened upward with a hinge portion (located on the rear side; not shown) as a pivot center. When the top cover 4 is opened, access to the inside of the printer main body 3 is enabled and maintenance work such as ink cartridge replacement can be performed. The disc tray cover 7 is a cover which covers an insertion slot of a disc tray (not shown). The disc tray cover 7 is such that its bottom side can be opened forward with a hinge portion (located on the top side; not shown) as a pivot center.

When the disc tray is used, the disc tray cover 7 is opened and an optical disc such as a CD-R, a CD-RW, or a DVD is set on the disc tray with its label face up and inserted through the disc tray insertion slot. When the disc tray is inserted manually to a prescribed position, then the disc tray is automatically guided into a transporting path. The top side of the ejection stacker 50 can be opened forward with a hinge portion (located on the bottom side; not shown) as a pivot center. The ejection stacker 50 is opened during execution of recording. The top face of the opened ejection stacker 50 serves as a stacking face 51 on which sheets P which have been subjected to the recording are to be stacked.

The automatic feeder 2 is equipped with: a feeding tray 5 on which plural sheets P can be stacked; a hopper 16 for pushing up the sheets P on the feeding tray 5; a feeding roller 14 for picking up upper sheets P on the feeding tray 5 by a pinched feeding action of itself and the hopper 16; a separation pad 8 for separating following ones of multiply-fed sheets P from the top sheet P to send out only the top sheet P finally; and a returner 1 for returning the separated following sheets P onto the feeding tray 5.

As shown in FIG. 1, a cover 9 which also serves as the feeding tray 5 occupies a rear portion of the top face of the printer main body 3. The front side of the cover 9 is opened upward and then obliquely rearward with a hinge portion (located on the rear side; not shown) as a pivot center, whereby the feeding tray 5 which is an inner face of the cover 9 is made usable.

Next, the internal structure of the ink jet printer 100 will be outlined in the same order as a sheet P goes along the transporting path. First of all, the feeding tray 5 on which sheets P are to be stacked is provided at the upstream end in the transporting direction. The feeding tray 5 is provided with edge guides (not shown) which are brought in contact with the side ends (edges) the sheets P and guide them so that they are transported smoothly in a secondary scanning direction Y which is the transporting direction of the sheet P. The sheets P on the feeding tray 5 are pushed up toward the feeding roller 14 by the hopper 16 which rises with prescribed timing as a rotary shaft 17 of the feeding roller 14 is rotated. As the feeding roller 14 rotates, sheets P are picked up in order from the top sheet P by a unit number of sheets P at a time with the aid of the separation pad 8 disposed in the vicinity of the feeding roller 14, and then sent out downstream in the transporting direction.

A detection lever (not shown) for detecting passage of a sheet P is disposed downstream of the feeding roller 14. Transporting rollers 19 that are a driving roller 19*a* and a follower roller 19*b* are disposed downstream of the detection lever. Of the transporting rollers 19, the follower roller 19*b* is rotatably supported at the downstream end of a roller holder 18 which is provided so as to be able to pivot about a pivot shaft 18*a*, and is urged by a torsion coil spring 18*b* so as to always establish a nip state that the follower roller 19*b* is in pressure contact with the driving roller 19*a*.

An auxiliary pressing roller 18*c*, which is disposed downstream of the roller holder 18 in the transporting direction, is rotatably supported by a roller holder 18*d* for the auxiliary pressing roller so as to be capable of follower rotation. The auxiliary pressing roller 18*c* is provided for such purposes as prevention of head rubbing that is caused by a rise of the tail of a sheet P. A sheet P being transported while being pinched by the transporting rollers 19 goes under the auxiliary pressing roller 18*c* and is introduced to a recording position 26.

A carriage 10 which is supported by a guide shaft 12 and can reciprocate in a primary scanning direction X is provided at the recording position 26 for performing recording on a sheet P. A recording head 13 for performing recording by ejecting ink toward a sheet P or the like is mounted on the bottom face of the carriage 10. An ink cartridge (not shown) is attached to the carriage 10.

A platen 28 which is opposed to the recording head 13 and defines a platen gap PG between the head face of the recording head 13 and a sheet P or the like is disposed under the recording head 13. Desired recording is performed on the almost entire recording face of a sheet P or the like by alternately repeating an operation of transporting the sheet P or the like by a prescribed transport length between the carriage 10 and the platen 28 in the secondary scanning direction Y which is perpendicular to the primary scanning direction X and an operation of causing the recording head 13 to eject ink toward the sheet P or the like while the recording head 13 is reciprocated once in the primary scanning direction X. The platen gap PG is a very important factor for high-precision recording and is adjusted when necessary in accordance with a variation in the thickness of the sheet P or use of the disc tray, for example.

Ejecting rollers 20 that are an driving roller 20*a* and a follower roller 20*b* are disposed downstream of the recording head 13. Ejection assistance rollers 20 for assisting ejection of a sheet P is disposed downstream of the ejecting roller 20 in the transporting direction. The ejection assistance rollers 20 are a driving roller 22*a* and a follower roller 22*b*. A sheet P that has been ejected by the ejection assistance rollers 22 are ejected to the stacking face 51 of the ejection stacker 50 which is disposed downstream of the ejection assistance rollers 22 in the transporting direction.

Each of the follower roller 20*b* and the follower roller 22*b* is a spur roller having plural teeth at the outer circumference and is rotatably supported by an individual roller holder. The follower roller 19*b* is disposed in such a manner that its axis is located somewhat downstream of the axis of the driving roller 19*a* in the transporting direction. The above-described arrangement causes a sheet P to assume, between the transporting rollers 19 and the electing rollers 20, a curved shape commonly called "reverse warp" that the sheet P is curved slightly so as to be convex downward. As a result, the sheet P that is opposed to the recording head 13 is pressed against the platen 28, whereby the sheet P is prevented from rising and the recording is performed normally.

The returner 1 is equipped with: a returning lever 31 which pivots about a rotary shaft 30 as the feeding roller 14 rotates; and a holder 32 which slides in the same direction as the hopper 16 as the hopper 16 moves in an escaping direction (obliquely downward). The free end of the returning lever 31 is provided with a hook member 33. As shown in FIGS. 4-7 the returning lever 31 is pivoted counterclockwise and the hook member 33 is thereby engaged with the bottom ends of upper sheets P1 of remaining, multiply-fed sheets P. In this manner, the returning lever 31 pushes and returns the upper sheets P1 toward the feeding tray 5. A cam 34 is attached to the rotary shaft 30 of the returning lever 31. The details of the cam 34 will be described later.

The holder 32 is a member which acts on sheets P2 that are lower than the upper sheets P1 and mainly serves to return the lower sheets P2 toward the feeding tray 5. When the lower sheets P2 are moved toward the feeding tray 5, an escaping space 35 for the upper sheets P1 is secured, which allows the returning lever 31 to return the upper sheets P1 reliably.

The top face of the holder 32 is a supporting face 36 which is relatively smooth and supports the bottom ends of the sheets P that are stacked on the feeding tray 5. A high-friction material 37 which is shaped like a rectangular flat plate, for example, is stuck to the supporting face 36 to increase the ability of holding the sheets P that are stacked on the feeding tray 5. A support frame 38 which is a part of a frame of the automatic feeder 2 and supports the bottom ends of the sheets P that are stacked on the feeding tray 5 is disposed under the feeding tray 5. The support frame 38 is formed with a guide groove 40 which is engaged with a guide pin 39 which projects horizontally from the side face of the holder 32 at a position close to its rear end (i.e., close to the hopper 16).

The guide pin 39 is a rod-shaped member and the guide groove 40 is a groove whose width is slightly greater than the diameter of the guide pin 39. Therefore, the holder 32 can slide approximately by the length of the guide groove 40 over which the guide pin 39 can move. An engagement projection 41 which is engaged with the hopper 16 when the hopper 16 is moved in the escaping direction projects upward from the top face of the holder 32 at a position close to its rear end. As such, the holder 32 can be moved rearward by the escaping action of the hopper 16.

On the other hand, a front portion of the holder 32 is formed with a hook 42. One end of a spring 43 which is stretched between the holder 32 and the support frame 38 is hooked on the hook 42. The other end of the spring 43 is hooked on a hook 44 of the support frame 38. As such, the holder 32 is always urged forward by the spring 43. When engaged with the hopper 16, the holder 32 is moved rearward against the urging force of the spring 43. The holder 32 can move forward when disengaged from the hopper 16.

The bottom face of the holder 32 is formed with a cam follower 45 which is brought in contact with the cam 34 and thereby transmits driving force from the cam 34 to the holder 32. The cam 34 starts to contact the cam follower 45 at the beginning of a feeding operation of sheets P (see FIG. 4). The cam height increases gradually as shown in FIGS. 5 and 6 and reaches a maximum at the end of the operation of returning sheets P (see FIG. 6).

Figure 6:
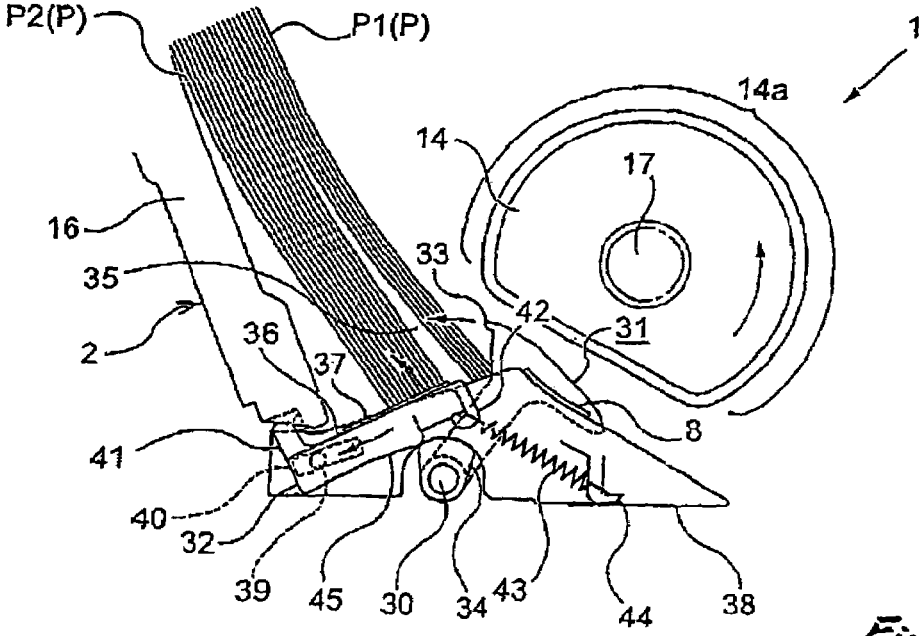
FIG. 6 is an enlarged side section view of the returner and its peripheries, showing a state that the sheet returning action is executing.
Figure 7:
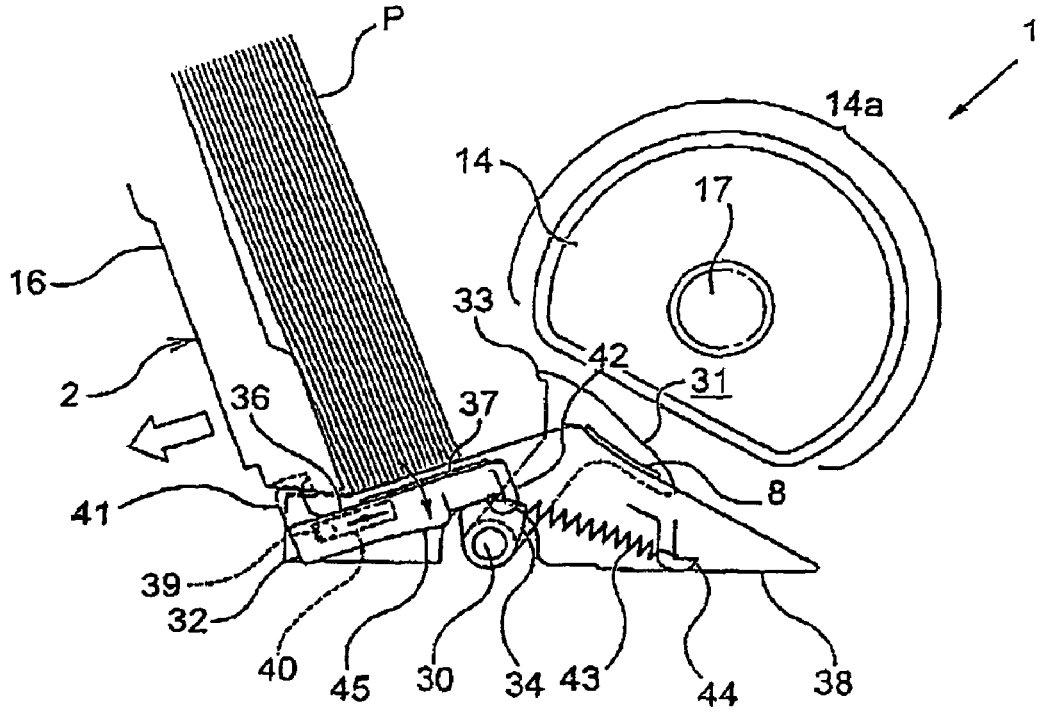
FIG. 7 is an enlarged side section view of the returner and its peripheries, showing a state that the sheet returning action is finished.
Figure 8:
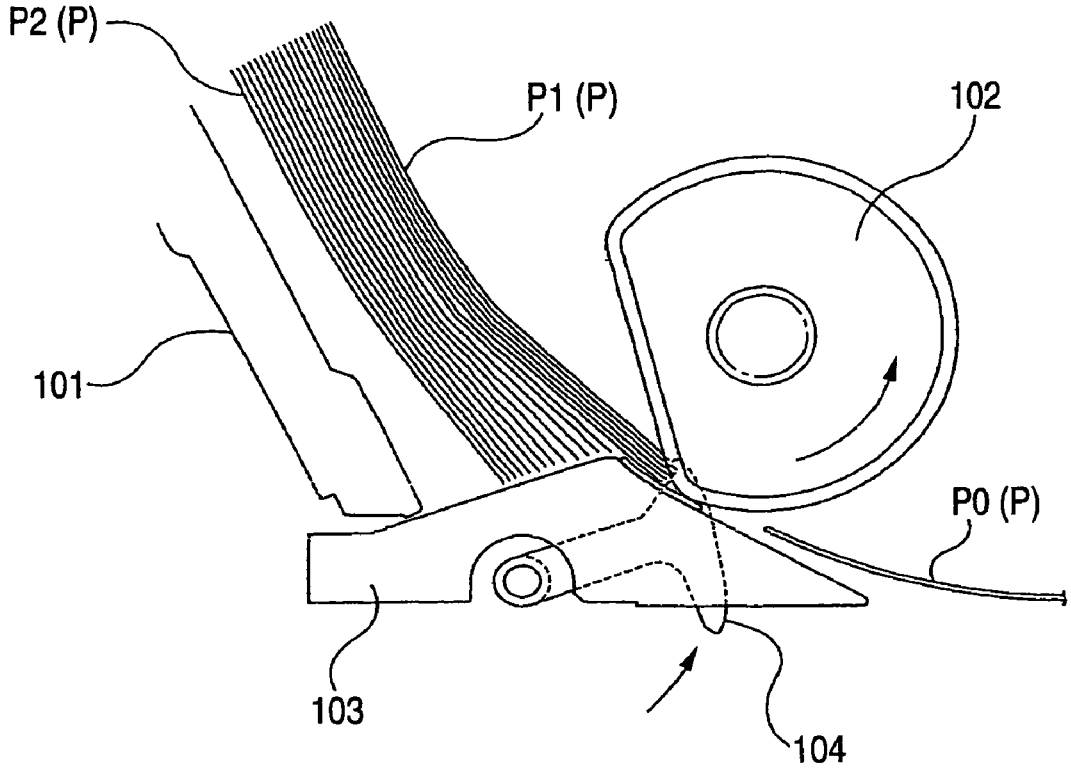
PRIOR ART FIG. 8
FIG. 8 is an enlarged side section view of a related-art returner and its peripheries.

In the state of FIG. 7 in which the hopper 16 is lowered further from the position of FIG. 6, the cam 34 has slipped down the cam follower 45 and their contact is canceled.

Next, the operation of the returner 1 will be described separately for (1) at the beginning of the sheet feeding operation, (2) at the beginning of a sheet returning operation, (3) in the course of the sheet returning operation, and (4) at the end of the sheet returning operation.

Figure 4:
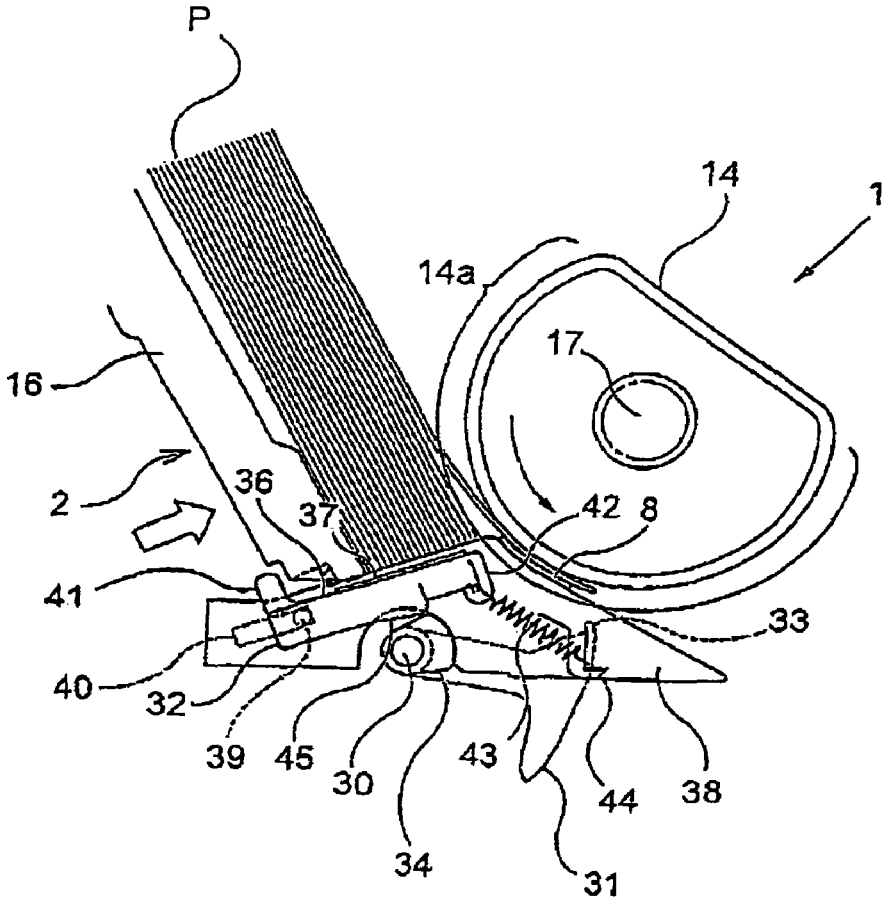
FIG. 4 is an enlarged side section view of the returner and its peripheries, showing a state that a sheet feeding operation begins.
Figure 5:
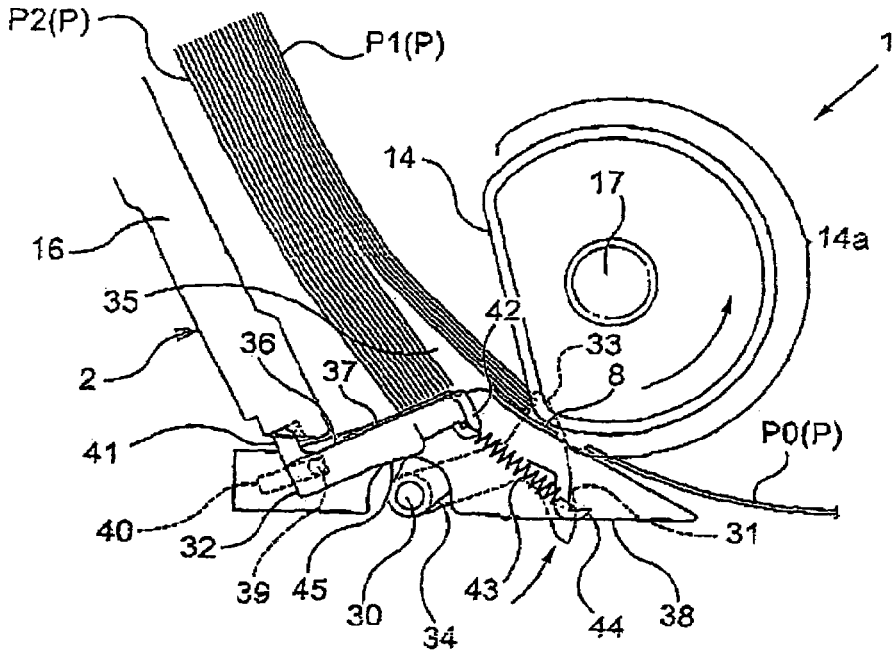
FIG. 5 is an enlarged side section view of the returner and its peripheries, showing a state that a sheet returning action begins.

(1) As shown in FIG. 4, the hopper 16 is elevated and the sheets P stacked on the feeding tray 5 are thereby lifted up. The top sheet P0 of the sheets P stacked on the feeding tray 5 is pressed against the feeding roller 14. Then, upper sheets P1 including the top sheet P0 are pulled out of the feeding tray 5 as the feeding roller 14 rotates. The upper sheets P1 excluding the top sheet P0 are separated from the top sheet P0 by the separating action of the separating pad 8 and remain halfway in the transporting path.

(2) After an end of a contact face 14*a* of the feeding roller 14 has passed the upper sheets P1, as shown in FIG. 5, the hopper 16 starts to be lowered. The hook member 33 of the returning lever 31 goes into the transporting path and is engaged with the bottom ends of the remaining upper sheets P1. The holder 32 is slid rearward as the hopper 16 goes down, and is rotated counterclockwise (in FIG. 5) as the cam height of the cam 34 increases.

(3) As the hopper 16 goes down further, as shown in FIG. 6 the holder 32 is moved rearward with its guide pin 39 guided by the guide groove 40. During this course, since the high-friction material 37 is stuck to the supporting face 36 of the holder 32, the remaining lower sheets P2 are moved rearward together with the holder 32, as a result of which an escaping space 35 is formed between the upper sheets P1 and the lower sheets P2. As the returning lever 31 is rotated in such a situation, the hook member 33 of the returning lever 31 pushes and returns the remaining upper sheets P1. The upper sheets P1 reach the escaping space 35 which is formed over the supporting face 36.

(4) In the above state, the inclination angle of the holder 32 is at the maximum and the centers of gravity of the upper sheets P1 and the lower sheets P2 on the supporting face 36 are much deviated to the feeding tray 5 side. The hopper 16 is lowered further from this position and the holder 32 is thereby moved rearward. As a result, as shown in FIG. 7, the cam 34 slips down the cam follower 45 and their contact is canceled. At the same time, the inclination angle of the holder 32 is decreased. Resulting impact is transmitted to the upper sheets P1 and the lower sheets P2 on the supporting face 36, whereby the sheets P1 and P2 which have remained on the feeding tray 5 are returned to the prescribed positions on the feeding tray 5 as shown in the figure.

Although the basic configurations of the returner 1 according to the invention, the automatic feeder 2 having the returner 1, the recording apparatus 100 or the like having the returner 1 are as described above, it is naturally possible to, for example, modify or omit parts of the configurations without departing from the spirit and scope of the invention. For example, the friction of the supporting face 36 of the holder 32 may be increased by forming the supporting face 36 itself using a material having a large coefficient of friction or subjecting the supporting face 36 to proper face processing or the like. In this case, it is not necessary to stick the high-friction material 37.

By modifying the shape of the guide groove 40 properly or providing plural guide pins 39 and plural guide grooves 40, it is also possible to cause the holder 32 to not only move rearward but also rotate as the hopper 16 moves in the escaping direction. This makes it possible to omit the cam 34 and the cam follower 45. Further, the returner 1 according to the invention and the automatic feeder 2 can be applied to, in addition to the recording apparatus 100 or the like, various kinds of transport apparatus which handle sheet-like transport objects.

Figure 9:
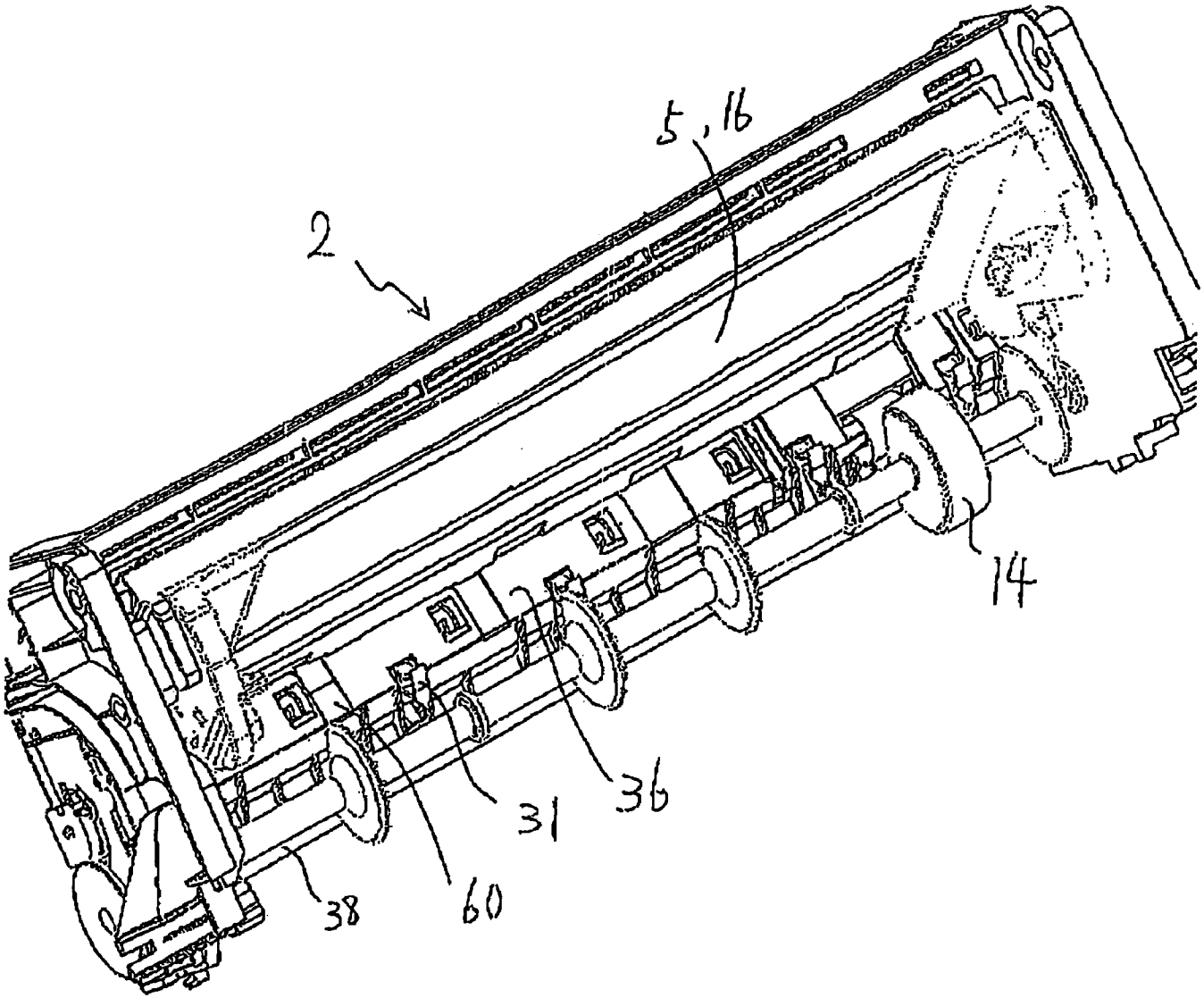
FIG. 9 is a perspective view of an internal structure of an automatic feeder in the ink jet printer.
Figure 10:
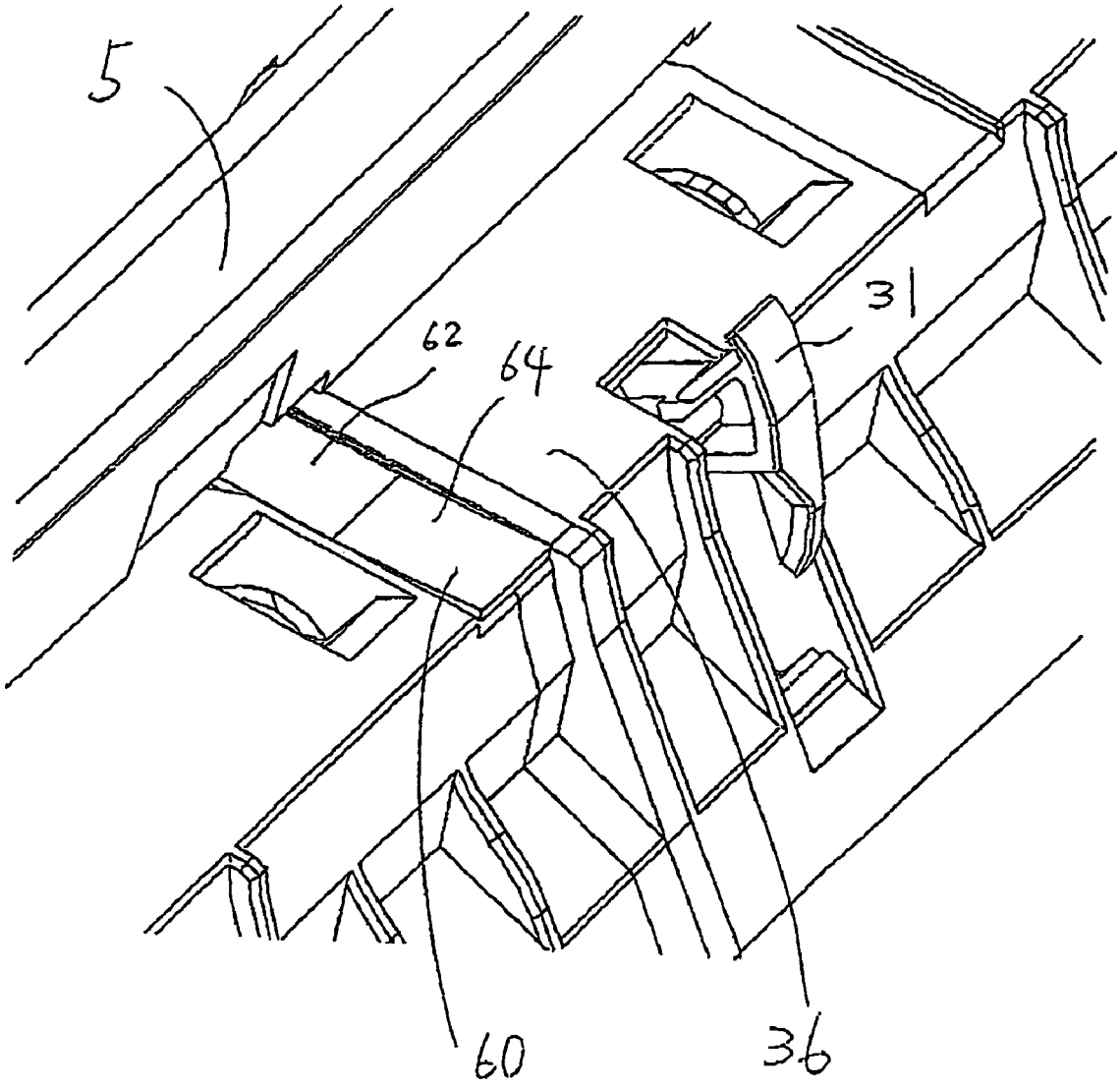
FIG. 10 is an enlarged perspective view of a main part of the automatic feeder.
Figure 11:
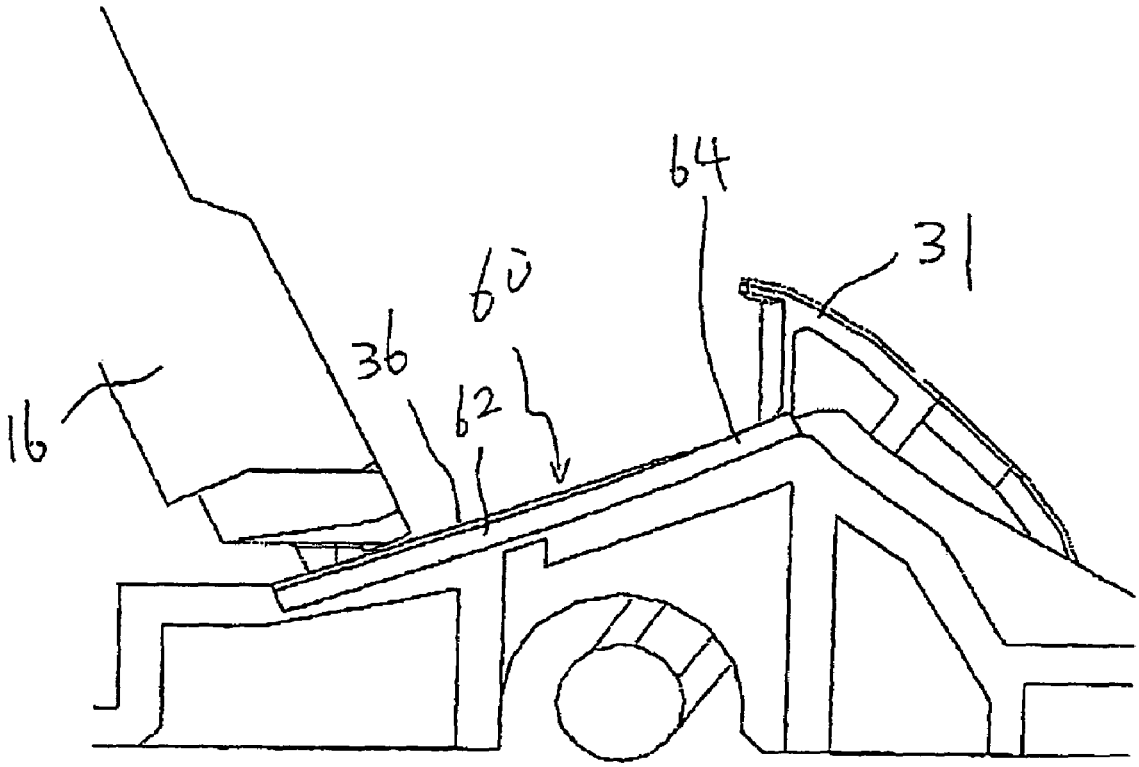
FIG. 11 is an enlarged side section view of the main part of the automatic feeder.

FIG. 9 is a perspective view outlining the internal structure of an automatic feeder according to the invention. FIG. 10 is an enlarged perspective view of an important part of FIG. 9. FIG. 11 is a side section view of the important part of FIG. 9. A thin-plate-like friction member 60 made of a cork material is provided on the supporting face 36 in a region (a left-hand region in FIG. 9) where the sheet feeding mechanism (i.e., the feeding roller 14 etc.) is not provided. A front portion 64 of the friction member 60 is slightly curved so as to convex toward a frame supporting face 36 and its rear portion 62 is slightly curved so as to be concave toward the supporting face 36. That is, the friction member 60 is provided so as to cover the supporting face 36 in the transporting direction in a reliable manner. In this embodiment, the thin-plate-like friction member 60 is stuck to the supporting face 36. The curvature of the convex shape of the front portion 64 is set so that its projection length does not cause an unduly heavy load during a sheet feed but the friction between the sheet ends and the supporting face 36 (see FIGS. 10 and 11). The friction member 60 is provided so that sheets that have been returned by the returning lever 31 after a sheet feed operation stay reliably at the return destination positions by virtue of the friction.

The reason why the friction member 60 is provided in the above manner is as follows. By increasing the frictional resistance between the sheet ends and the supporting face 36 by means of the friction member 60, it is intended to allow the sheet ends to stay at the prescribed positions reliably when sheets are returned to those positions. In a structure in which the friction member 60 is not provided at the above-mentioned position, one side (not associated with the sheet feeding mechanism) of the end (edge) of each sheet is supported only by the supporting face (free state). In a sheet feed operation, the two sides of the end of each sheet that are associated with and not associated with the sheet feeding mechanism, respectively, are not fed simultaneously; the free portion tends to be fed earlier than the intended timing. In contrast, where the friction member 60 is provided, when a sheet feed operation is started, the two sides of the end of each sheet are fed simultaneously, that is, the phenomenon that one side is fed earlier does not occur.

What is claimed is:

1. An automatic feeder, adapted to feed a plurality of media one by one to a downstream section, comprising:

a feeding tray, adapted to support the media thereon;

a feeding roller;

a hopper, provided on the feeding tray so as to be movable in a first direction for pushing the media toward the feeding roller so that a top one of the media comes in contact with the feeding roller, and in a second direction opposite to the first direction;

a separator, adapted to separate a first group including at least one of the media which is situated under the top one of the media from the top one, so that only the top one is fed to the downstream section by rotation of the feeding roller;

a returning lever, pivotable about a pivot shaft interlockingly with the feeding roller and adapted to return a second group including at least one of the media in the first group, which has been proceeded from a prescribed position to the downstream section together with the top one of the media, to the feeding tray; and a holder, having a supporting face on which a third group including at least one of the media in the first group which is situated under the second group is placed, the holder being slidable in the second direction interlockingly with the movement of the hopper in the second direction to move the third group toward the feeding tray, while holding the third group, to secure a space to which the second group is returned by the returning lever.

2. The automatic feeder as set forth in claim 1, wherein a high-friction member is provided on the supporting face of the holder.

3. The automatic feeder as set forth in claim 1, further comprising a frame member having a supporting face on which the first group is placed, the frame member formed with a groove extending in the second direction, wherein the holder comprising a projection slidably fitted with the groove.

4. The automatic feeder as set forth in claim 1, further comprising an elastic member urging the holder in the first direction, wherein the holder comprising a projection adapted to engage with the hopper when the hopper is moved in the second direction.

5. The automatic feeder as set forth in claim 1, further comprising a rotation cam provided on the pivot shaft of the returning lever, wherein the holder is formed with a cam follower so that the holder is pivotable in accordance with rotation of the rotation cam, thereby varying an inclination angle of the supporting face.

6. A recording apparatus incorporating the automatic feeder as set forth in claim 1, comprising:

a recording head, disposed in the downstream section and operable to record information on the top one of the media fed by the feeding roller.

7. A liquid ejecting apparatus incorporating the automatic feeder as set forth in claim 1, comprising:

a liquid ejecting head, disposed in the downstream section and operable to eject liquid toward the top one of the media fed by the feeding roller.

* * * * *